US006530870B2

(12) United States Patent
Buchman et al.

(10) Patent No.: US 6,530,870 B2
(45) Date of Patent: Mar. 11, 2003

(54) METHODS OF MANUFACTURING RECLOSABLE PACKAGES; AND PACKAGES MADE THEREBY

(75) Inventors: James E. Buchman, Hortonville, WI (US); Paul A. Tilman, Sherwood, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 83 days.

(21) Appl. No.: 09/737,366

(22) Filed: Dec. 15, 2000

(65) Prior Publication Data

US 2002/0077238 A1 Jun. 20, 2002

Related U.S. Application Data

(60) Provisional application No. 60/200,164, filed on Apr. 27, 2000.

(51) Int. Cl.[7] ..... B31B 1/90

(52) U.S. Cl. ..... 493/394; 493/114; 493/927

(58) Field of Search ..... 493/394, 114, 493/213, 927; 53/550, 555, 133.4, 551, 451, 450

(56) References Cited

U.S. PATENT DOCUMENTS

| | | | | |
|---|---|---|---|---|
| 2,257,433 A | | 9/1941 | Stokes | |
| 3,839,128 A | | 10/1974 | Arai | 156/583 |
| 4,736,450 A | | 4/1988 | Van Erden et al. | 383/65 |
| 4,909,017 A | * | 3/1990 | McMahon et al. | |
| 4,941,307 A | | 7/1990 | Wojcik | 53/412 |
| 5,275,491 A | * | 1/1994 | Kuge et al. | |
| 5,448,807 A | * | 9/1995 | Herrington | |
| 5,592,802 A | | 1/1997 | Malin et al. | 53/133.4 |
| 5,692,837 A | * | 12/1997 | Beer | |
| 5,776,045 A | | 7/1998 | Bodalay et al. | 493/215 |
| 5,782,733 A | | 7/1998 | Yeager | 493/213 |
| 5,816,018 A | | 10/1998 | Bois | 53/133.4 |
| 5,937,615 A | | 8/1999 | Forman | 53/133.4 |
| 5,956,924 A | * | 9/1999 | Thieman | 53/133.4 |
| 5,964,532 A | * | 10/1999 | Phillips et al. | |
| 6,000,197 A | | 12/1999 | Ausnit | 53/412 |
| 6,032,437 A | | 3/2000 | Bois | 53/412 |
| 6,131,369 A | | 10/2000 | Ausnit | 53/412 |
| 6,212,857 B1 | | 4/2001 | Van Erden | 53/412 |
| 6,293,896 B1 | | 9/2001 | Buchman | 493/213 |

* cited by examiner

*Primary Examiner*—Eugene Kim
*Assistant Examiner*—Sameh Tawfik
(74) *Attorney, Agent, or Firm*—Julie R. Daulton; Tracey D. Beiriger

(57) ABSTRACT

A method of making packages having a reclosable zipper closure by a vertical form, fill and seal process. The method includes providing a pocket in a film web into which a zipper closure is positioned and attached. The film web is folded and sealed to form side panels and seams, which result in a package. The pocket provides an internal tamper evident-structure for the package. An external tamper evident-structure can be provided between the distal ends of the mating profiles of the zipper closure.

12 Claims, 13 Drawing Sheets

METHODS OF MANUFACTURING RECLOSABLE PACKAGES; AND PACKAGES MADE THEREBY

Priority under 35 U.S.C. § 119(e) is claimed to provisional application serial No. 60/200,164, filed on Apr. 27, 2000, and entitled "Methods of Manufacturing Reclosable Packages; and Packages". The complete disclosure of application Ser. No. 60/200,164 is incorporated by reference herein.

FIELD OF THE DISCLOSURE

This disclosure concerns reclosable packages. In particular, this disclosure describes methods of manufacturing reclosable packages using vertical form, fill, and seal techniques, and the packages made thereby.

BACKGROUND

Multitudes of consumable goods are available packaged in flexible packages such as plastic bags. Many goods that are not used completely when the package is initially opened rely on a zipper closure to reclose the package and keep the remaining contents fresh. Examples of consumable goods that are often packaged in resealable and reclosable packages, such as bags, with a zipper closure include potting soil, fertilizer, pet food, dog biscuits, vegetables, cereal, and many different foods edible by humans.

Form, fill, and seal technology is known in the packaging industry as a method to manufacture the resealable packages and to package the consumable goods within those resealable packages. Improvements in this type of manufacturing process, and the packages produced, are desirable.

SUMMARY OF THE DISCLOSURE

The present disclosure relates to a method of manufacturing a package, such as a flexible bag, having a resealable, reclosable zipper closure mechanism by a vertical form, fill and seal process. A first tamper evident-structure is provided on the interior of the zipper closure to provide evidence whether access has been gained to the interior of the package. A second tamper-evident structure can be further provided on the exterior of the zipper closure to provide evidence whether access has been gained to the interior of the package.

In particular, the present disclosure relates to a vertical form, fill and seal process that manufactures the flexible package, fills the package with items, and seals the filled package. The zipper mechanism and seals are applied to the package preferably in the same process as filling of the package.

In one aspect, a method of manufacturing a reclosable package is provided, the reclosable package having first and second sides defining a package width and the zipper closure extending the width of the package. The method comprises providing a film web having first and second edges and forming first and second notches in the film web at the first and second edges. A pocket is formed in the film web between the first and second notches. A zipper closure, having a first interlocking mating profile and a second interlocking mating profile, each profile having a sealing flange and an opposite distal end, is inserted into the pocket and the sealing flanges are attached to the pocket. The first side edge and the second side edge of the film web are joined approximately perpendicular to the zipper closure to form a casement. The method further includes forming a bottom edge to provide an interior defined by the casement and the bottom edge; and forming a top edge. Packages made by this method, and use of these packages, are also disclosed.

This disclosure also is directed to an apparatus for making packages. A vertical form, fill and seal machine is provided that includes a film supply source for providing a film web, a zipper closure supply source, at least one punch positioned to form a notch in the film web, a plunger centered between edges of the film web, and a folding system for folding the film web.

The present disclosure also is directed to packages made by the methods or apparatus disclosed. Use of these packages is also disclosed.

Detailed Description

The process described herein produces and fills a reclosable package. A first, internal, tamper-evident structure for the package is provided by the process described herein. A second, external, tamper evident-structure may also be provided by the process. The process of manufacturing the package is accomplished on a machine commonly referred to as a vertical form, fill, and seal machine.

Figure 1:
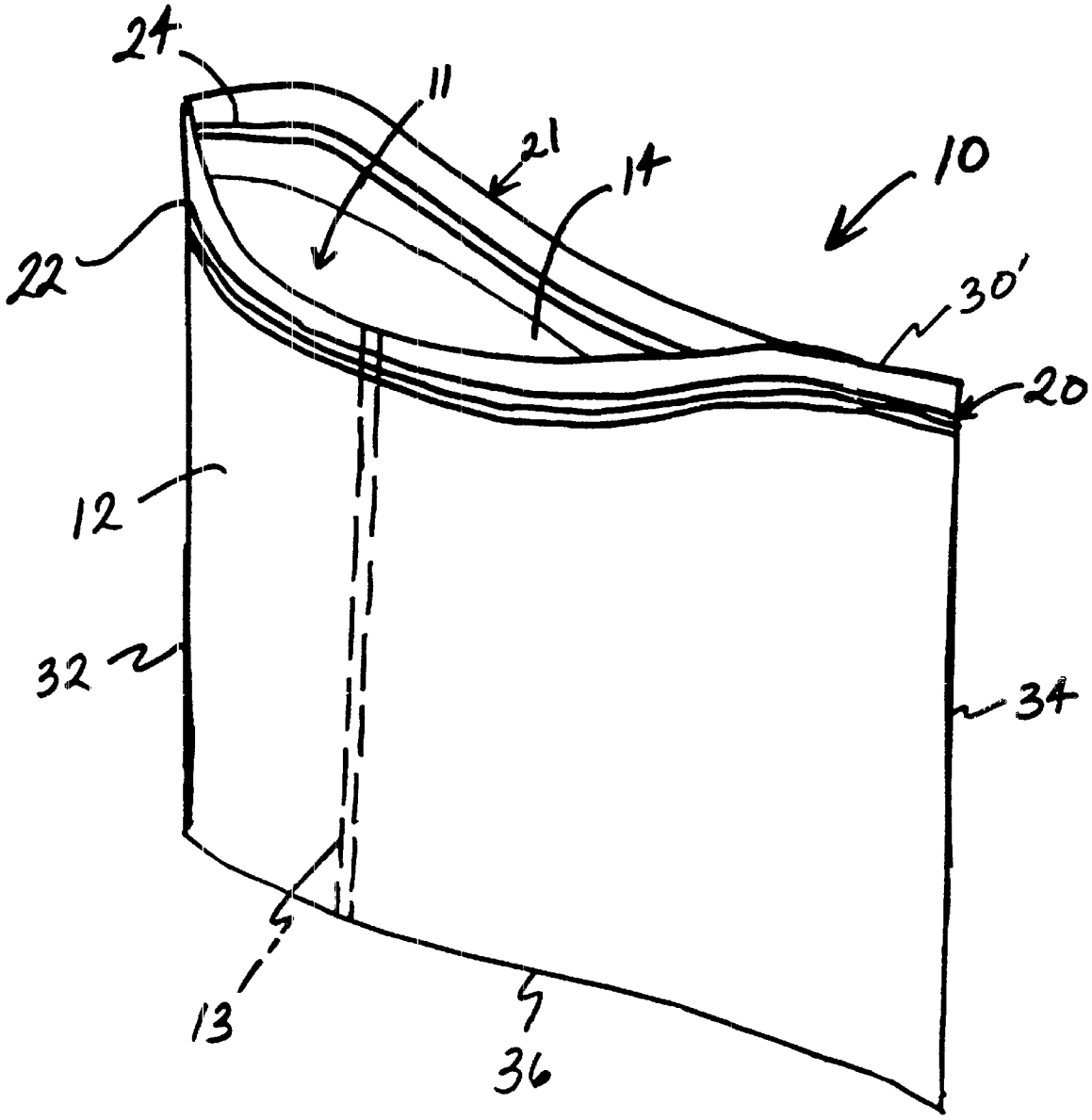
FIG. 1 is a perspective view of a flexible, reclosable package shown with access available to the interior of the package.
Figure 2:
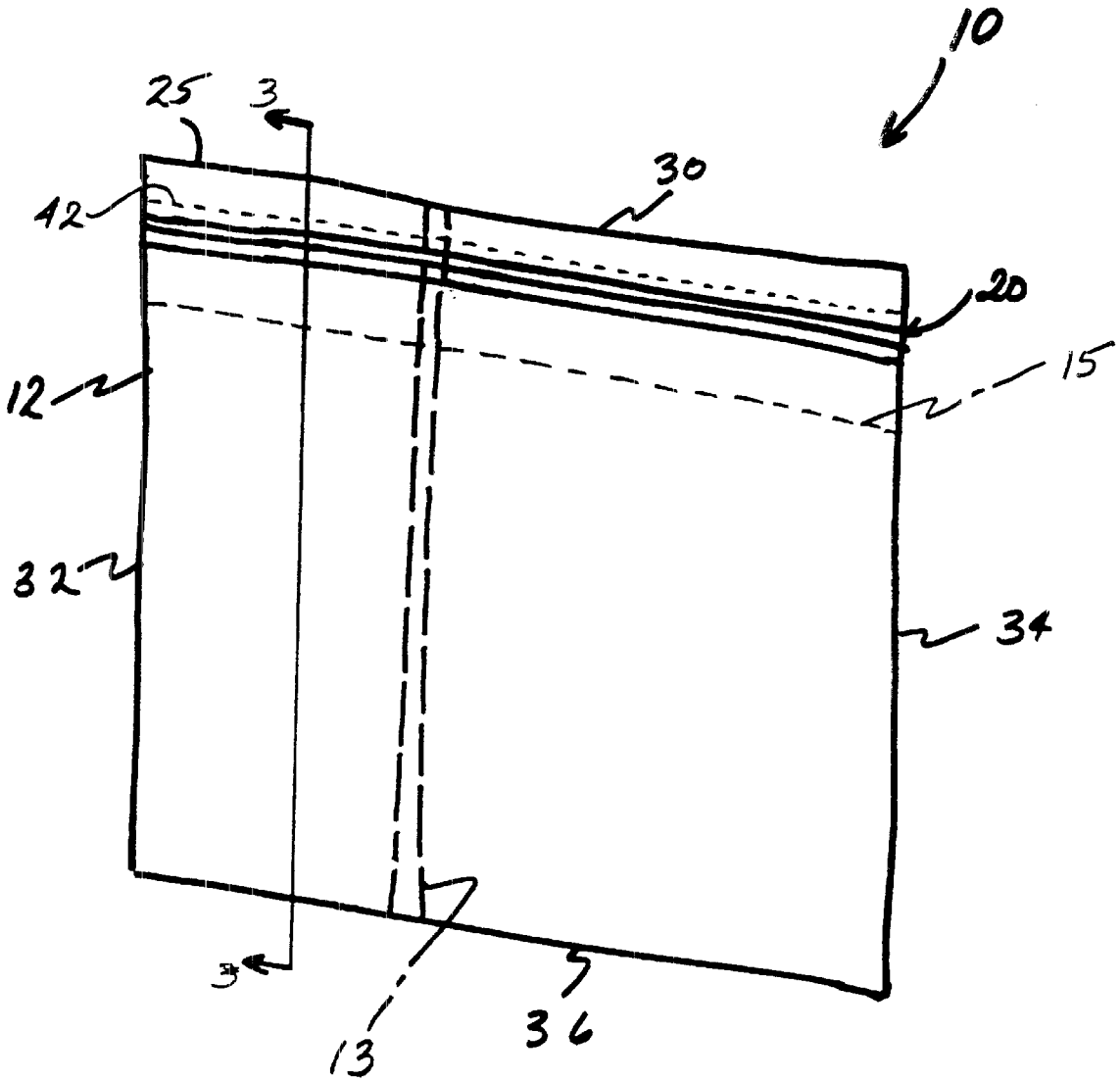
FIG. 2 is a side view of the flexible, reclosable package of FIG. 1 having first and second tamper-evident structures intact.

Two configurations of a flexible, reclosable package 10 are shown in FIGS. 1 and 2. In FIG. 1, package 10 is shown with the tamper evident-structures breached, providing access to the interior of the package. In FIG. 2, package 10 is shown with the tamper evident-structures in place.

Package 10 has first and second opposed side panels 12 and 14 defining an interior 11; side panels 12, 14 are generally polymeric film, but can be a laminate of other materials such as film and paper. Package 10 includes opposite side edges 32, 34 and bottom edge 36. The distance between first side edge 32 and second side edge 34 is the width of package 10. Preferably, each of first side edge 32 and second side edge 34 is a fold line between side panels 12, 14, which is formed when a single sheet of film is folded to form the two side panels 12, 14. Bottom edge 36 is a seam, created by the application of heat and pressure to side panels 12, 14. Preferably, the single sheet of film that forms side panels 12, 14 is sealed at seam 13, shown in phantom in FIGS. 1 and 2. Such a seam 13 is positioned within one of side panels 12, 14 and is often referred to as a "fin seal".

Package 10 also has a top edge 30 (FIG. 2), which is the edge of package 10 closest to mouth 21 and most distant from bottom edge 36. In FIG. 1, top edge 30' is the top of package 10 after tamper evident-structure 25 (FIG. 2) has been removed from the package; tamper evident-structure 25 is described below in detail. The terms "top" and "bottom" are relative terms used in respect to package 10 as shown in FIGS. 1 and 2, as will be explained below. It is understood that package 10 can be positioned in different orientations, so that, for example, top edge 30, 30' would not be at the top most portion of the figure but would be positioned else where. However, no matter in what orientation package 10 is, top edge 30, 30' is the edge of package 10 closest to mouth 21 and most distant from bottom edge 36.

A zipper closure arrangement 20 having mating profiles to open and close (unseal and reseal) the mouth 21 of package 10 extends across the width of package 10; that is, zipper closure 20 extends from first side edge 32 to second side edge 34. The zipper closure 20 can include a variety of configurations and structures. Zipper closure 20 can be configured in any known manner, for example, such as disclosed in U.S. Pat. Nos. 4,240,241; 4,246,288; and 4,437,293; each of which is incorporated by reference herein. In some embodiments, zipper closure 20 may not extend the entire width of package 10, but may end short of at least one of first side edge 32 and second side edge 34.

Figure 3:
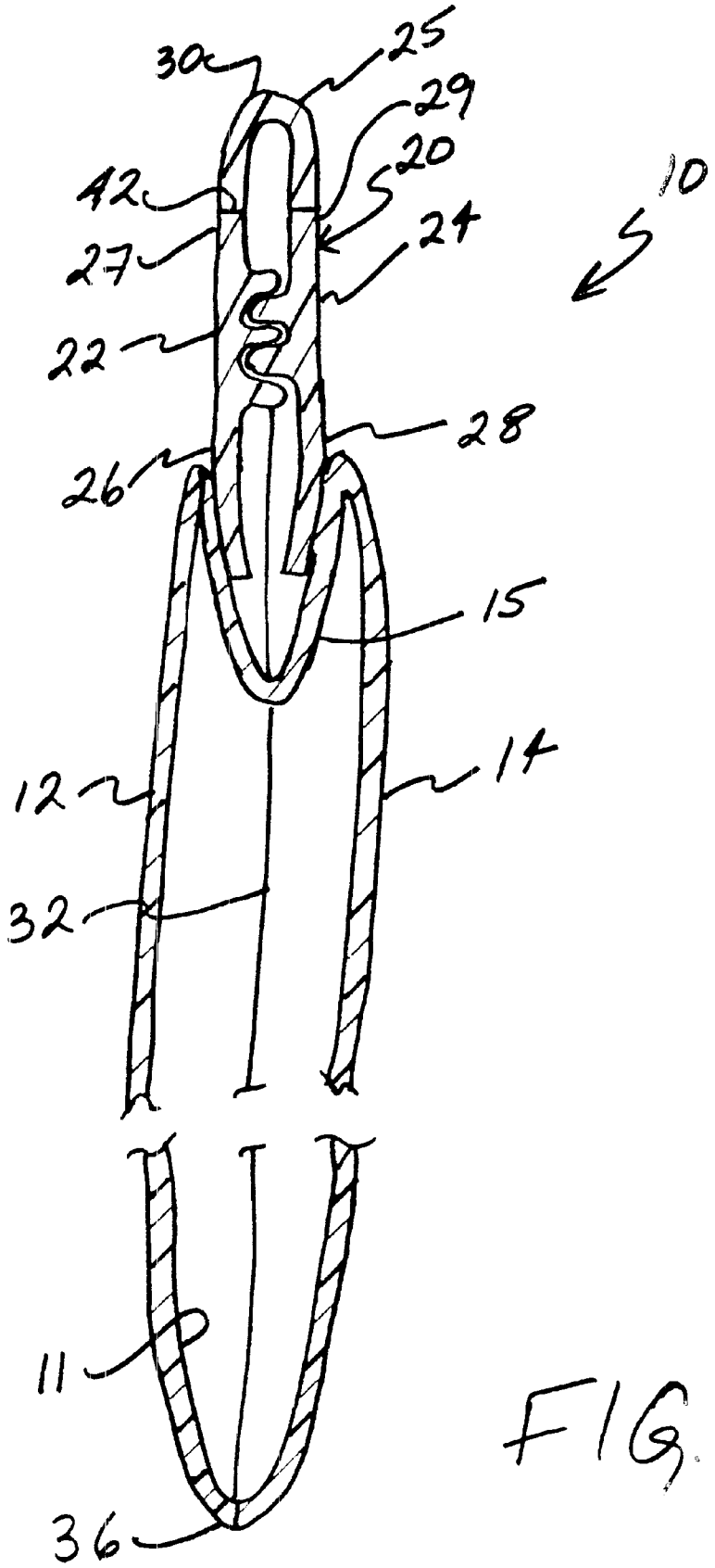
FIG. 3 is a cross-sectional view of the flexible, reclosable package taken along line 3—3 of FIG. 2.
Figure 4:
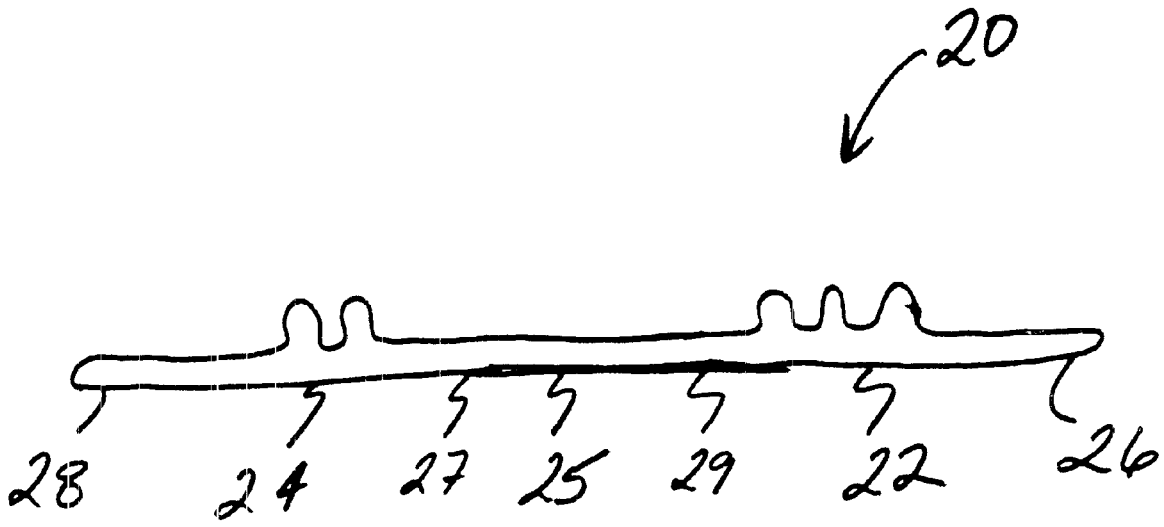
FIG. 4 is a side view of an unfolded zipper closure prior to incorporation into a package.

Referring to FIG. 1, and also to FIGS. 3 and 4, zipper closure 20 has a first mating profile 22 and a second mating profile 24 which engage and disengage, as appropriate, to open and close package 10. As stated above, zipper closure 20 generally extends from first side edge 32 of the package to second side edge 34 at mouth 21. First and second mating profiles 22, 24 of zipper closure 20 are attached to side panels 12, 14, respectively, by sealing flanges 26, 28 (FIGS. 3 and 4) as will be described in detail below. Opposite sealing flanges 26, 28 are the distal ends 27, 29 (FIGS. 3 and 4) of mating profiles 22, 24.

In FIG. 1, package 10 is shown with the interior 11 of the package accessible through mouth 21; in FIGS. 2 and 3, package 10 has first tamper evident-structure 15 and second tamper evident-structure 25 blocking access to the interior. By "tamper-evident", it is meant that the structure provides an indication to the consumer as to whether that feature of the package has been previously penetrated or opened. In order to gain access to the interior 11, each of tamper evident-structures 15, 25 must be penetrated or otherwise breached.

First tamper evident-structure 15, shown in FIGS. 2 and 3, is a structure to indicate whether access has been gained to the interior 11 of package 10. Tamper evident-structure 15 is sealed to, and extends between sealing flanges 26, 28 (FIG. 3). First tamper evident-structure 15 is considered an "internal" tamper evident-structure because it is positioned between the mating profiles 22, 24 of zipper closure 20 and the package interior 11. First tamper evident-structure 15 is not a structure that is commonly referred to as a "peel seal"; rather, tamper evident-structure 15 is a structure such as a membrane, film, web, or the like that extends from side panel 12 to side panel 14. As will be described below in reference to the methods of making package 10, first tamper evident-structure 15 is typically and preferably the same film used for side panels 12, 14; that is, tamper evident-structure 15 is integral with side panels 12, 14.

Also present on package 10 in FIGS. 2 and 3 is a second tamper evident-structure 25 encasing zipper closure 20; second tamper-evident structure 25 indicates whether mating profiles 22, 24 have been separated. As best seen in FIG. 2, second tamper-evident structure 25 covers and forms a complete enclosure or envelope around the zipper closure 20. In some embodiments, second tamper evident-structure 25 may not completely encase zipper closure 20; rather, in some embodiments, discontinuous sealing or spot sealing of distal ends 27, 29 (FIGS. 3 and 4) to form second tamper evident-structure 25 may be acceptable. Second tamper evident-structure 25 is considered an "external" tamper evident-structure because it is positioned external to the zipper closure 20 in relation to the package interior 11. Typically, second tamper evident-structure 25 is a membrane, film, web or the like; however, in some embodiments, second tamper evident-structure 25 can be a structure commonly referred to as a "peel seal". Second tamper evident-structure 25, in FIGS. 2 and 3, includes an area of weakness 42, such as a perforation, score line, zip strip, die line, laser score, or the like on each mating profile 22, 24 that is used to facilitate penetration of tamper evident-structure 25. In some embodiments, only one or any number of multiple areas of weakness may be positioned on second tamper-evident structure 25 or on mating profiles 22, 24.

In the embodiment shown in FIGS. 2 and 3, second tamper evident-structure 25 is formed by having first and second mating profiles 22, 24 connected together at their distal ends 27, 29 opposite sealing flanges 26, 28. In FIG. 4, zipper closure 20 is shown with first mating profile 22 integral with second mating profile 24; that is, first and second mating profiles 22, 24 are a single unit, connected by second tamper evident-structure 25 extending from first distal end 27 to second distal end 29. Such a structure can be made by extruding zipper closure 20 as a single structure. Alternately, second tamper evident-structure 25 can be made by sealing first and second mating profiles 22, 24 together at their distal ends 27, 29 before or after incorporating zipper closure 20 into package 10. This sealing can be done by spot welding, ultrasonic welding, with an adhesive, or any other manner. In another embodiment, a separate film or membrane can be used to connect the distal ends 27, 29.

Preferably, each of first tamper evident-structure 15 and second tamper evident-structure 25 extends along the length of zipper closure 20, from first side edge 32 to second side edge 34 (FIGS. 1 and 2). However, in some embodiments, one or both of first tamper-evident structure 15 and second tamper-evident structure 25 may not extend from first side edge 32 to second side edge 34, or may be intermittent along the width.

Figure 5:
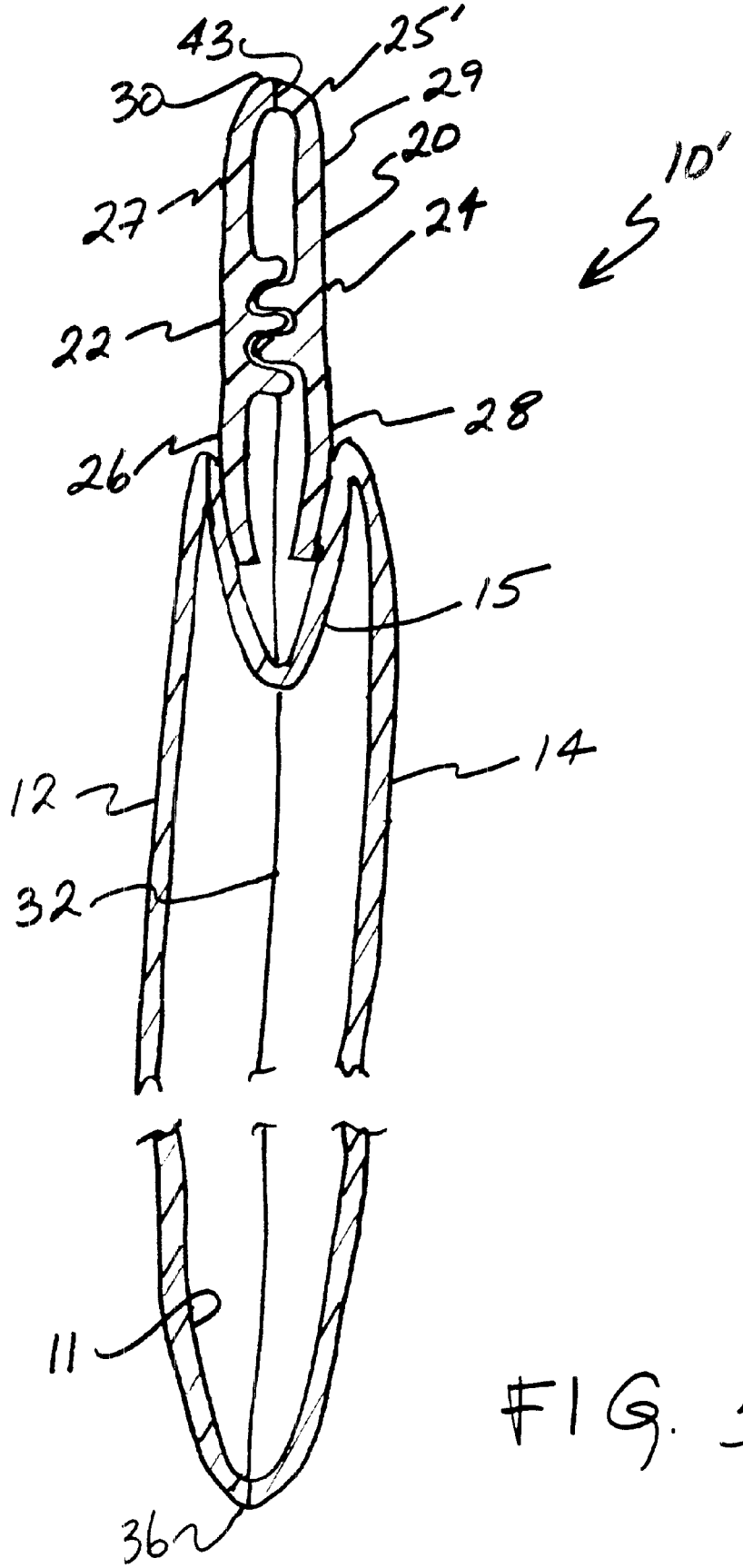
FIG. 5 is another embodiment of a flexible, reclosable package similar to the one shown in FIG. 3.

Similar to package 10 of FIGS. 2 and 3, package 10' of FIG. 5 has side panels 12, 14 that define interior 11 of package 10'. Package 10' includes first tamper-evident structure 15 between zipper closure 20 and package interior 11, and second tamper evident-structure 25' encasing zipper closure 20. First tamper-evident structure 15 is the same as first tamper-evident structure 15 of package 10. Second tamper evident-structure 25' includes an area of weakness 43, such as a perforation, score line, zip strip, die line, laser score, or the like equally spaced between mating profiles 22, 24. Similar to package 10 of FIGS. 2 and 3, in order to access the interior 11 of package 10', both first and second tamper-evident structures 15, 25' need to be penetrated or breached.

In order to gain access to the interior 11 of either package 10, 10', second tamper-evident structure 25, 25' and first tamper evident-structure 15 need to be penetrated. Second tamper-evident structure 25, 25' is penetrated via area of weakness 42, 43, or by some other method to expose zipper closure 20. With second tamper evident-structure 25, 25' penetrated, zipper closure 20 is exposed and first and second mating profiles 22, 24 can be unmated and separated. With mating profiles 22, 24 separated, first tamper evident-structure 15 is exposed for penetration.

First tamper evident-structure 15 can be penetrated or breached by an area of weakness present in the tamper-evident structure, or by cutting with a knife, blade, or the like.

The packages 10, 10' described and disclosed in FIGS. 1 through 3 and 5 are manufactured by vertical form, fill and seal techniques in accordance with the present disclosure. The packages, whether with or without the second tamper-evident structure 25, 25' are manufactured, filled, and sealed by a single process that includes multiple sequential steps. The zipper closure 20 and tamper evident-structures 15, 25 are applied to the package prior to the package being filled with any items.

Figure 6:
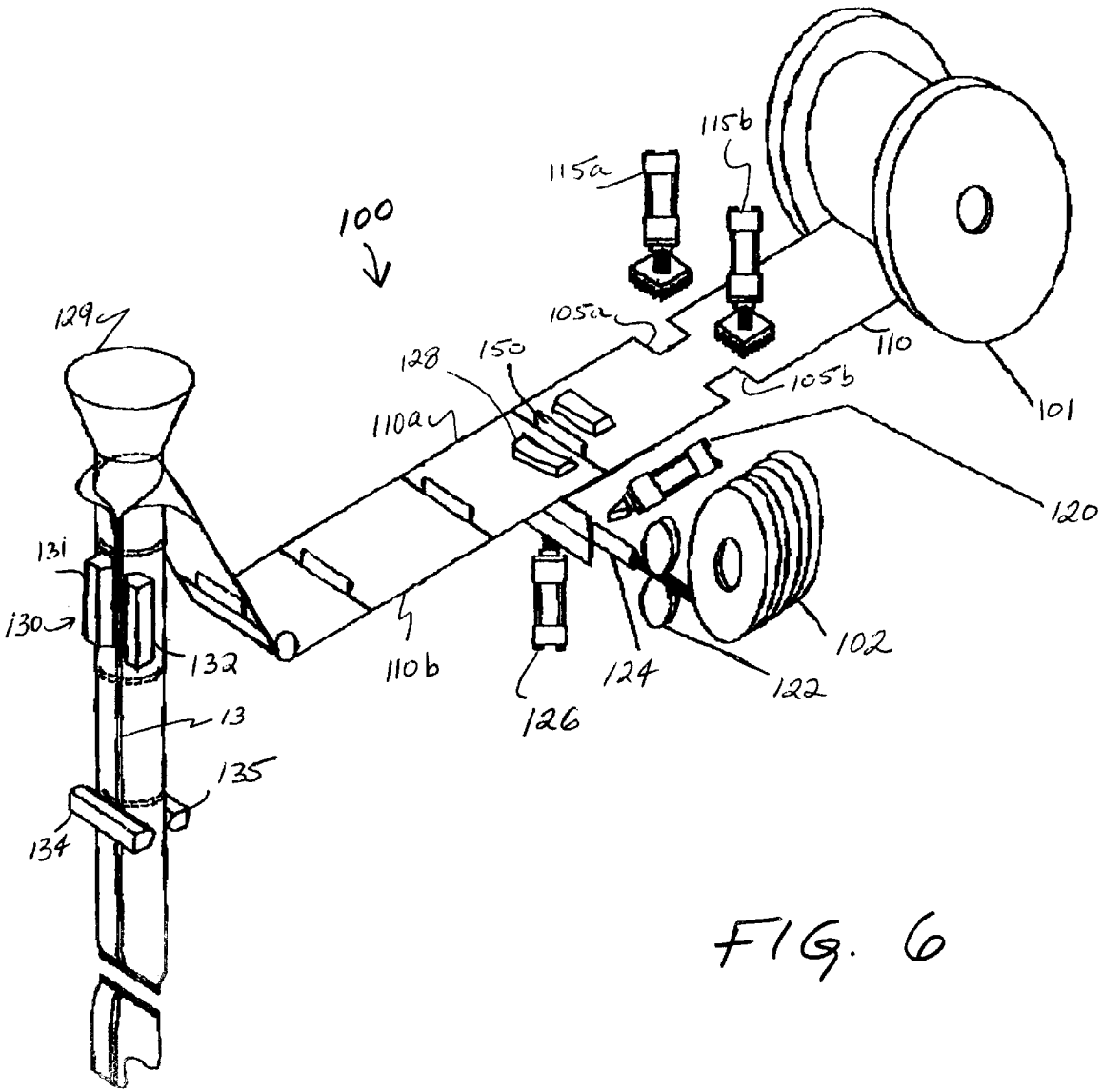
FIG. 6 is a schematic, front elevational view of a vertical form, fill and seal process of the present disclosure for producing flexible, reclosable packages similar to those depicted in FIGS. 1 through 3 and 5.

Referring to FIG. 6, a vertical form, fill and seal process, in accordance to the present disclosure, is shown at 100. As illustrated in FIG. 6, the process line progresses from right to left so that the final filled package is positioned at the left side of FIG. 6. It should be understood that other orientations and configurations of process 100 can be used with the teachings of the present disclosure; for example, the process can progress from left to right, or can be configured in any other manner. The package is manufactured in an upside-down orientation so that the filling takes place through the bottom edge 36 of the package (FIGS. 1 and 2), as it is manufactured.

Referring to FIG. 6, the process to manufacture and fill packages 10, 10' of FIGS. 1–3 and 5 will be described. Polymeric film 110, which provides the side panels 12, 14 (FIGS. 1–3 and 5), is provided on roll 101. The width of polymeric film 110 is the distance between film edges 110*a*, 110*b*, which is approximately equal to twice the width of package 10; the distance between film edges 110*a*, 110*b* is approximately twice the distance between side edge 32 and side edge 34 in FIGS. 1 and 2. In another embodiment, film 110 may be extruded, cast or otherwise formed immediately before this vertical form, fill and seal process, thereby eliminating the step of winding the film after forming the film and then unwinding the film when the packages are made.

Film 110 progress to punches 115*a*, 115*b* which die cut or otherwise remove a portion of film 110 along each edge 110*a*, 110*b* to form notches 105*a*, 105*b*, respectively. Punches 115*a*, 115*b* can utilize dies, knives, blades, heat, and the like to provide notches 105*a*, 105*b*. Notches 105*a*, 105*b* have a length (in the longitudinal or machine direction of film 110) that is approximately the length of first tamper evident-structure 15 (FIGS. 3 and 5); notches 105*a*, 105*b* each have a width (in the crossweb direction of film 110) that is approximately one-fourth of the width of film 110, from side edge 110*a* to side edge 110*b*. Thus, the width of film remaining between notches 105*a*, 105*b*, which forms pocket 150, is essentially one-half of the width of film 110, which is approximately the width of package 10 between side edges 32, 34 (FIGS. 1 and 2).

An extended length of zipper closure 20, with first closure profile 22 (FIGS. 1–5) and second closure profile 24 (FIGS. 1–5) interlocked, is provided via spool 102. Preferably, zipper closure 20 has integral mating profiles 22, 24, as shown in FIG. 4; such an arrangement of zipper closure 20 is generally made by extruding a single structure. Alternately, mating profiles 22, 24 can be extruded separately, and connected at their distal ends 27, 29 (FIGS. 3–5) prior to winding on spool 102. In another embodiment, mating profiles 22, 24 can be connected later in the process 100. If second tamper-evident structure 25 is a peel seal between distal ends 27, 29, this peel seal is typically present between distal ends 27, 29 when zipper closure 20 is on spool 102.

In embodiments where it is not desired to have second tamper evident-structure 25 present on the package, mating profiles 22, 24 are preferably interlocked but are not connected at distal ends 27, 29 (FIGS. 3–5).

As depicted in FIG. 6, zipper closure 20 is drawn from spool 102 by rollers 122, which feed zipper closure 20 to profile feed tube 124. Feed tube 124 can be any guide, tube or channel that positions zipper closure 20 with proper alignment for attachment to film 110. Zipper closure 20 is cut to its desired length by profile cutter 120; this can be done before or after zipper closure 20 is aligned within feed tube 124. Cutter 120 can be any mechanism to cut or otherwise provide a desired length to zipper closure 20; examples of usable cutters 120 include a single sharp edge, such as a knife blade, a heated edge, a pair of sharp edges, and ultrasonic vibration. The desired length of zipper closure 20 attached to film 110 is approximately one half the width of film 110; that is, zipper closure 20 does not extend from side edge 110*a* to side edge 110*b*, rather, zipper closure 20 extends approximately one half that distance. Zipper closure 20 extends between notches 105*a*, 105*b*.

A pocket 150 is formed in film 110 between notches 105*a*, 105*b* by profile plunger 126, which simultaneously folds pocket 150 and inserts zipper closure 20 into pocket 150. Pocket 150 results in first tamper evident-structure 15 (FIGS. 3 and 5) of packages 10, 10'. The process of providing pocket 150 and inserting zipper closure 20 therein is shown detailed in FIGS. 7–9.

Figure 7:
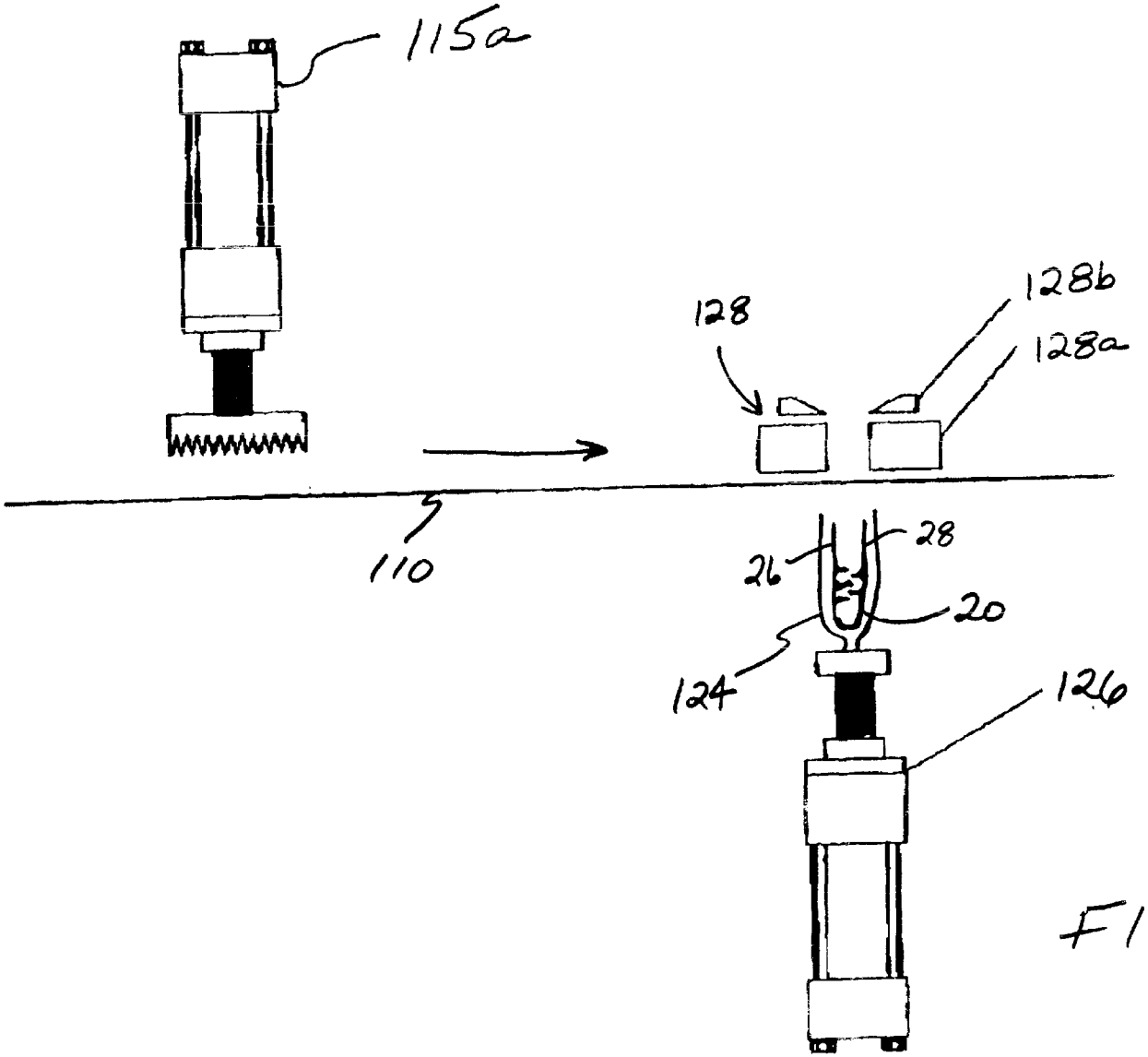
FIG. 7 is an enlarged, rear elevational view of a portion of the process of FIG. 6 per forming a first step.
Figure 8:
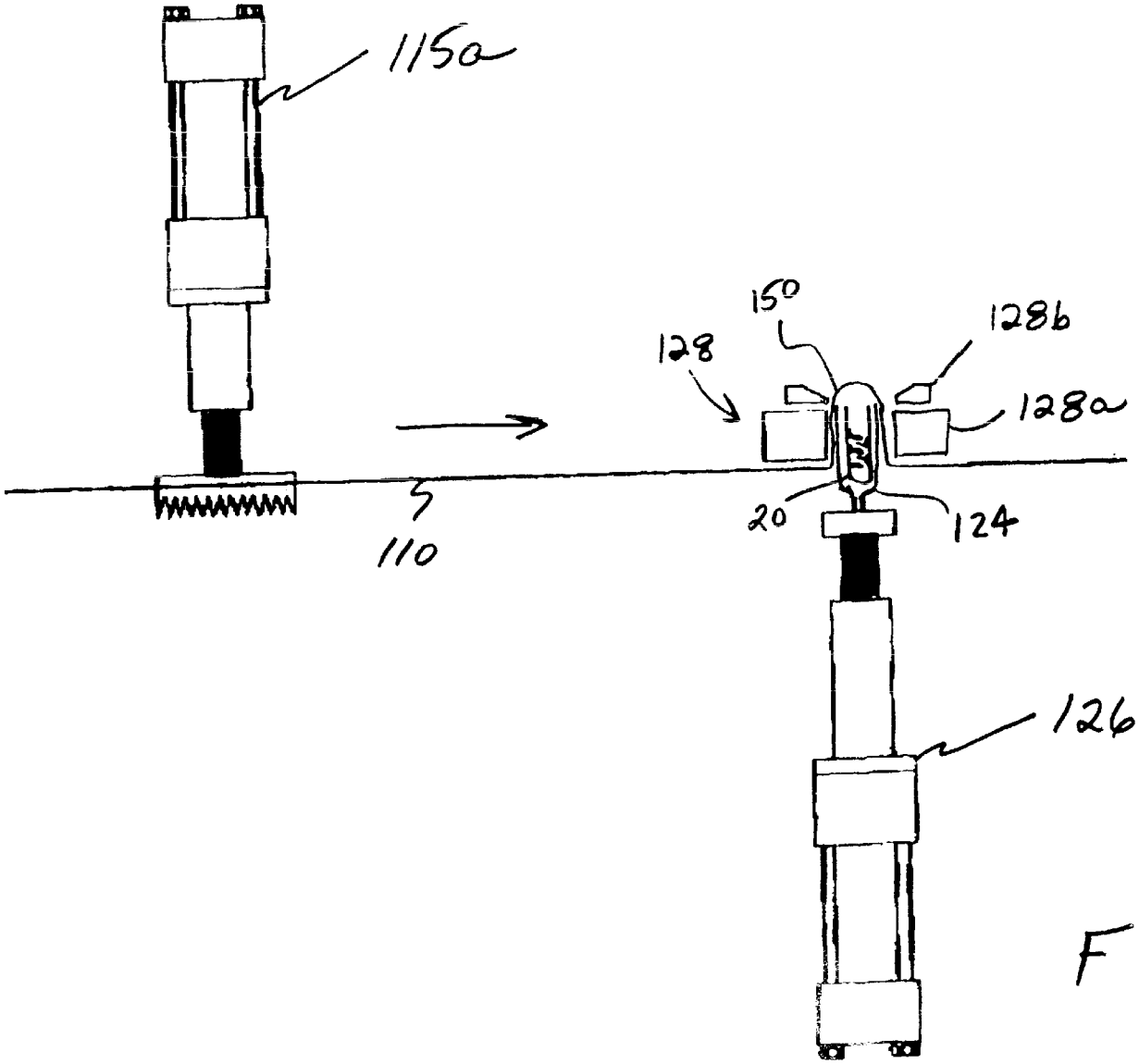
FIG. 8 is the process portion depicted in FIG. 7 performing a subsequent step.

In FIG. 7, profile plunger 126, with feed tube 124 connected thereto, retains zipper closure 20 with sealing flanges 26, 28 directed toward film 110. Punch 115*a*, positioned upweb from profile plunger 126, provides notch 105*a* (FIG. 6) in film 110. Film 110, with notch 105*a* therein, progresses (from left to right as shown by the arrow) to profile plunger 126. When aligned with notches 105*a*, 105*b*, plunger 126 forms pocket 150 in film 110, such as shown in FIG. 8, by pushing zipper closure 20 into film 110 and folding film 110. Zipper closure 20 may be placed in pocket 150 after pocket 150 has been made, or the insertion of zipper closure 20 may form pocket 150.

Figure 9:
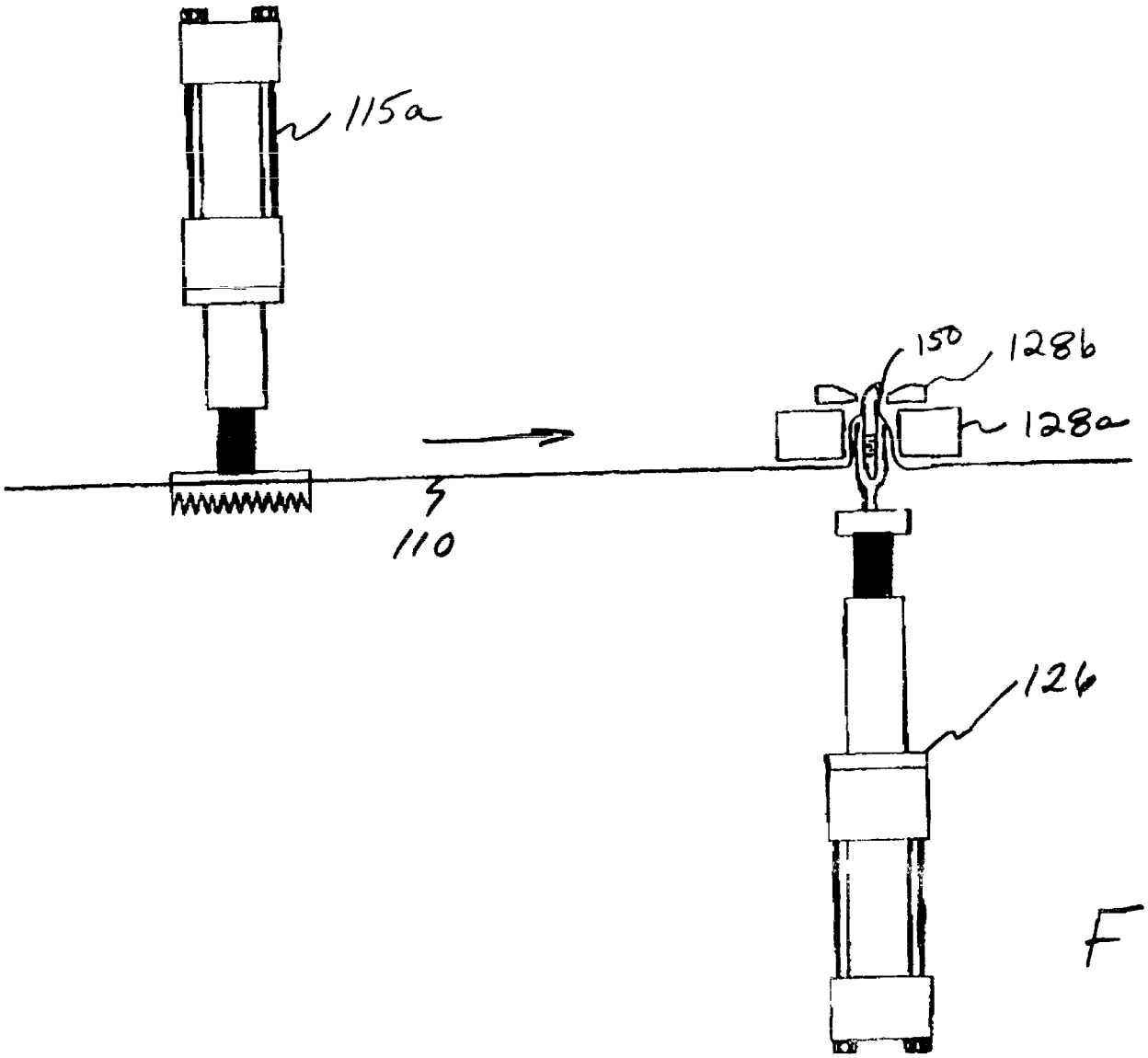
FIG. 9 is the process portion depicted in FIGS. 7 and 8 performing a further subsequent step.
Figure 10:
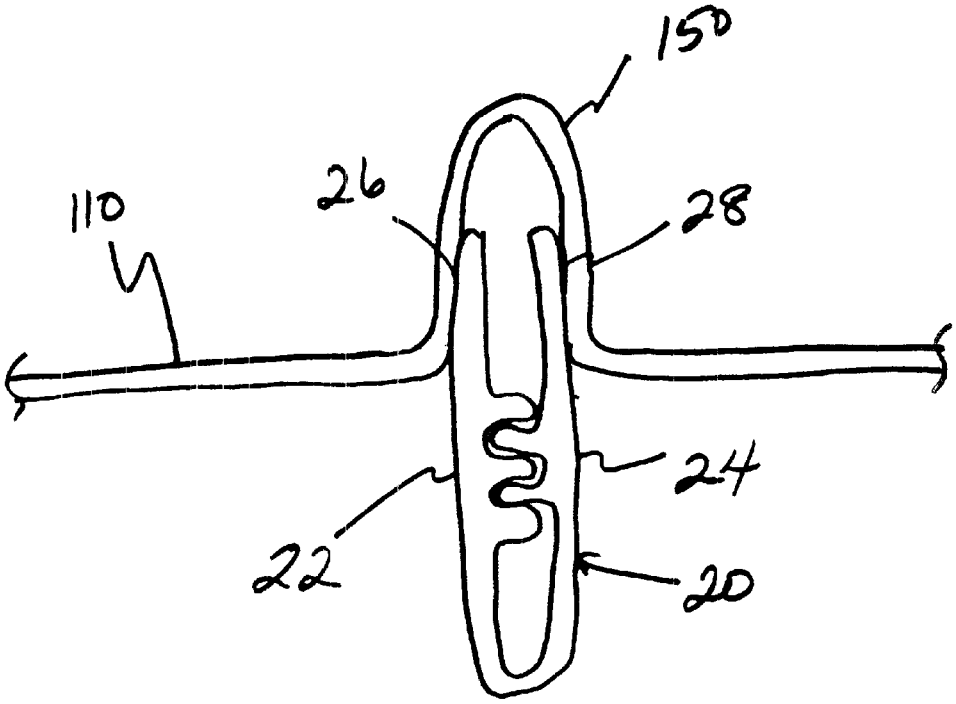
FIG. 10 is an enlarged view of the zipper closure attached to the film.

Pocket 150 is formed between sealing station 128, which includes film folder 128*a* and seal bars 128*b*. As shown in FIG. 8, zipper closure 20, retained in feed tube 124, is positioned within pocket 150. In FIG. 9, seal bars 128*b* seal or otherwise adhere pocket 150 to sealing flanges 26, 28 of zipper closure 20. These seal bars 128*b* apply heat, pressure, ultrasonics, or any combination thereof to film 110 at the areas where pocket 150 contacts sealing flanges 26, 28 of zipper closure 20. The energy applied by seal bars 128*b* is sufficient to at least pre-seal zipper closure 20 to pocket 150. Preferably, sealing flanges 26, 28 do not adhere or seal to one another but only seal to film 110 of pocket 150. An enlarged view of zipper closure 20, sealed to pocket 150 at sealing flanges 26, 28, is shown in FIG. 10.

Referring again to FIG. 6, film 110, with zipper closure 20 sealed within pocket 150, progresses to column 129. Column 129 folds film 110 and provides structure to film 110 during the following steps of the vertical form, fill and seal process 100. Various rollers, guides, tensioners, and the like can be used throughout process 100 to guide film 110.

Film 110 is folded around column 129 so that side edges 110*a*, 110*b* of film 110 are brought together; there may be a slight overlap of side edges 110*a*, 110*b*. The folded film 110 with the zipper closure 20 in pocket 150 progresses to seaming station 130, which provides seam 13 (FIGS. 1 and 2) by the application of heat, pressure, or both to the joined film side edges 110*a*, 110*b*. Seaming station 130 includes first seaming bar 131 and second seaming bar 132, either one, or both of which may be heated. Seaming bars 131, 132 extend essentially parallel to column 129 and film side edges 110*a*, 110*b*, and essentially perpendicular to zipper closure 20. Once seam 13 is produced, film 110 is in the form of a tube or casement 140. Seam 13 is typically perpendicular to zipper closure 20. The tube or casement 140 will provide side panels 12, 14 of package 10, 10'.

Figure 11:
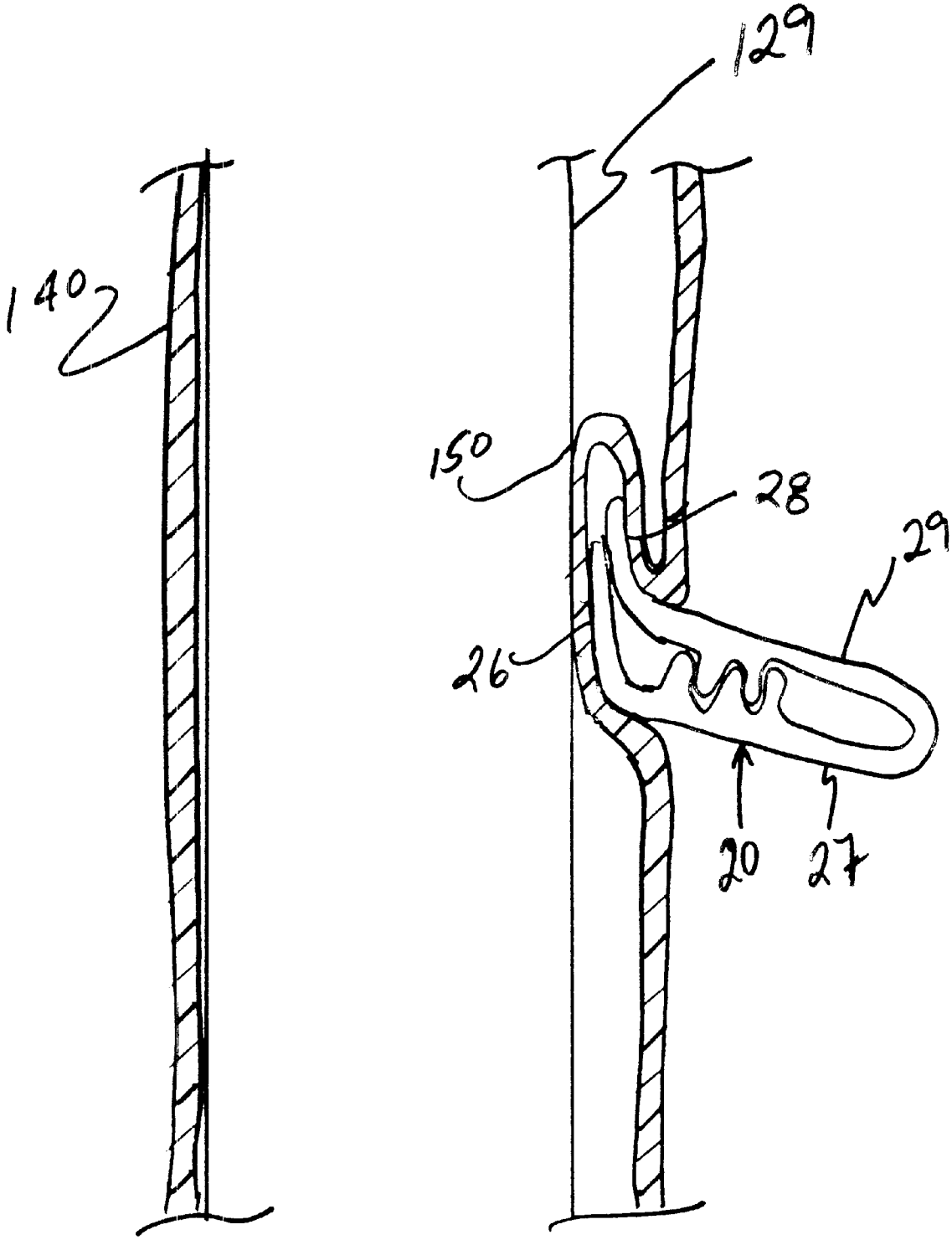
FIG. 11 is a side view of the film, with the zipper closure attached, on the forming column.

Tube 140 is arranged so that pocket 150, which extends along one half of tube 140, is in and on the interior side of tube 140, with the distal ends 27, 29 of zipper closure 20 extending exterior of tube 140; see FIG. 11, which shows the positioning of pocket 150 and zipper closure 20 when formed as tube 140. FIG. 11 shows tube 140, formed by column 129, with distal ends 27, 29 extending out from where sealing flanges 26, 28 are attached to pocket 150. Tube 140, with zipper closure 20 adhered to the inside of half of the tube material, progresses to sealing bars 134, 135 (FIGS. 6 and 12), which provide heat and pressure transversely across tube 140 to form various seals. These seals will eventually form bottom edge 36 (FIGS. 1–3 and 5) of the packages.

Process 100 (FIG. 6) can be adapted to form the packages in an upright or an upside down position. That is, the packages can be made with bottom edge 36 (FIGS. 1–3, 5 and 13) positioned below top edge 30 (FIGS. 2–3, 5 and 13) on column 129, so that the packages are filled through their top close to the mouth 21 (FIG. 1). Alternately, the packages can be made with top edge 30 positioned below bottom edge 36 on column 129, so that the packages are filled through their bottom. In either orientation, the process for manufacturing and filling the packages is similar.

Figure 12:
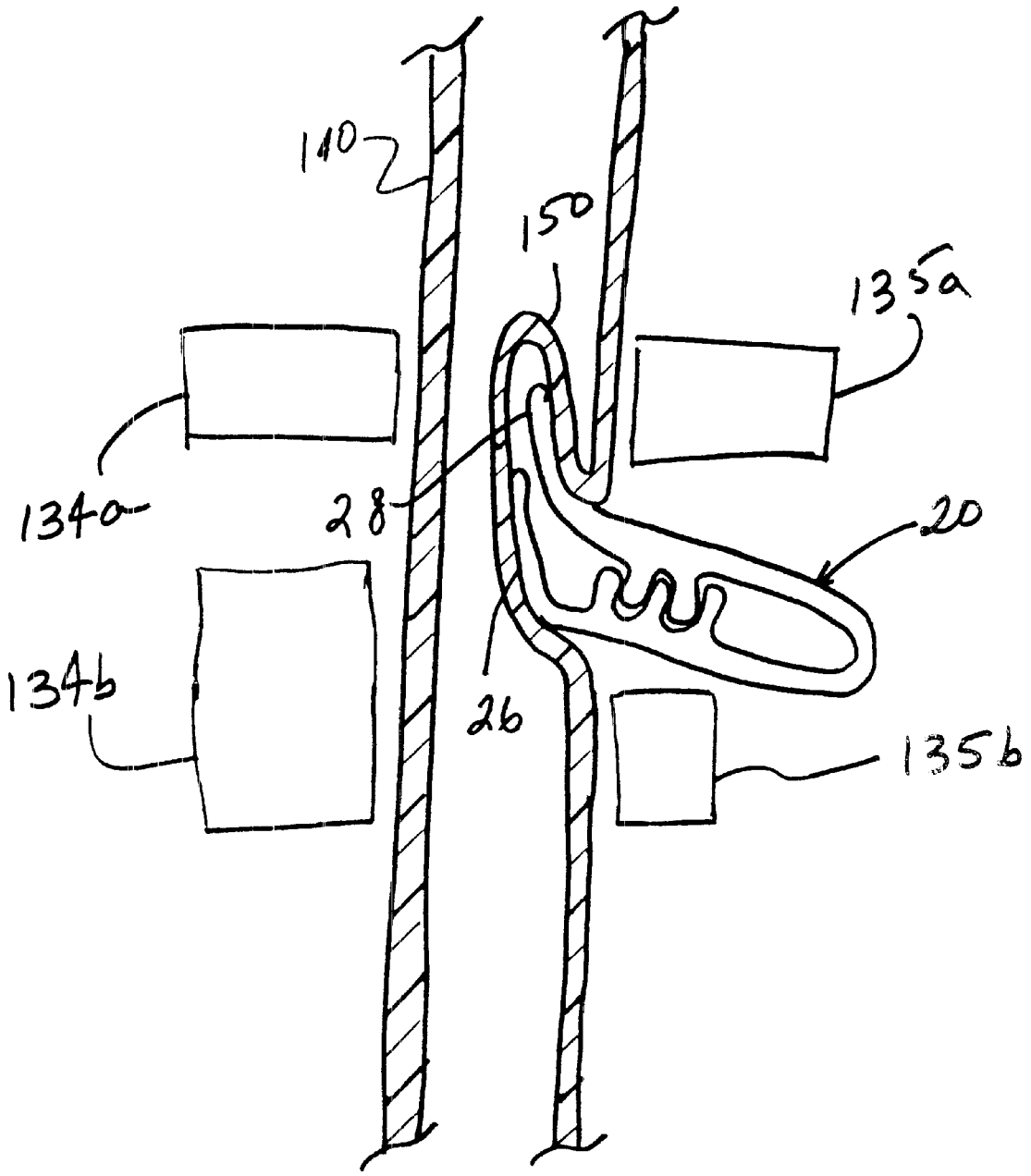
FIG. 12 is a side view of the film, with the zipper closure attached, prior to making top and bottom seals.
Figure 13:
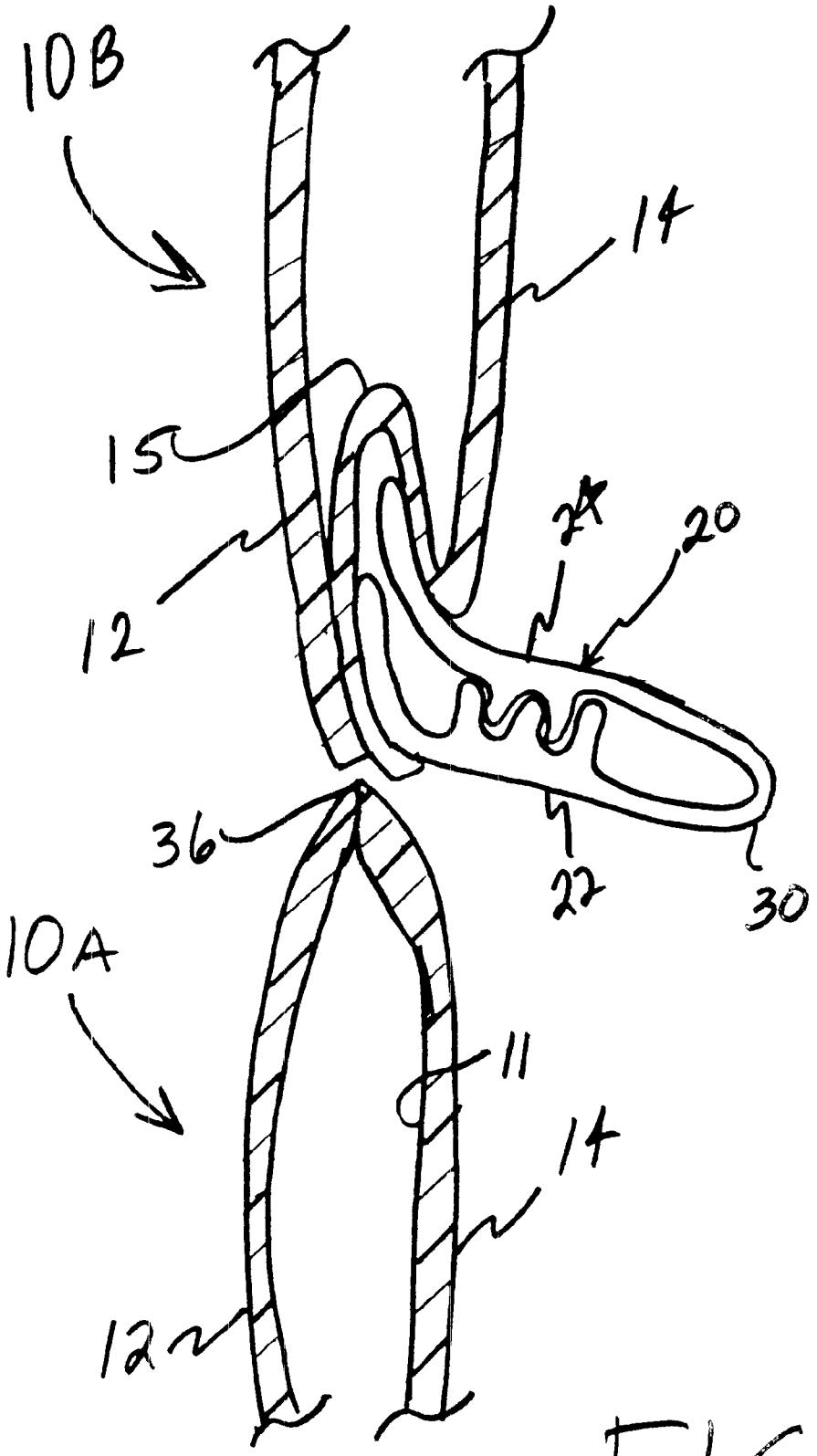
FIG. 13 is a partial side view of two packages after making top and bottom seals.

FIGS. 11–13 show the sequential steps of manufacturing and filling the packages in an upside down position; FIG. 13 shows fragments of finished packages 10A and 10B. It is understood that the process to manufacture the package in an upright orientation would be similar process, with sealing bars 134, 135 (FIG. 6) aligned different in relation to zipper closure 20 and pocket 150.

Referring to FIG. 11, tube 140 is shown on column 129. Film tube 140 extends around column 129, and zipper closure 20 attached within pocket 150 extends around one half of column 129. In FIG. 12, tube 140 has progressed along the length of and to the end of column 129 (FIG. 11) so that column 129 is no longer present in the interior of tube 140. With column 129 no longer positioned within tub 140, sealing bars 134, 135 (FIG. 6) come together to provide heat seals along tube 140. Specifically, sealing bars 134*a*, 134*b*, 135*a*, 135*b* (similar to sealing bars 134, 135 of FIG. 6) provide bottom edge 36 and top edge 30 of the resulting packages 10A, 10B (FIG. 13).

Sealing bars 134, 135 (FIG. 6) simultaneously adhere zipper closure 20 to tube 140 and also form bottom seal 36 of the adjacent package. Alternately, sealing bars 134, 135 sequentially adhere zipper closure 20 to tube 140 and form bottom seal 36. In other embodiments, such as shown in FIG. 12, different sealing bars 134*a*, 135*a* and 134*b*, 135*b* are used to form bottom seal 36 than are used to seal zipper closure 20 to the film web 140. The sealing bars can also be adapted to cut apart and separate adjacent packages.

As can be seen in FIG. 12, sealing bars 134*a*, 135*a* provide heat and pressure to tube 140 proximate to pocket 150; this results in a heat seal between a portion of tube 140 and pocket 150. Similarly, sealing bars 134*b*, 135*b* provide heat and pressure to tube 140; this provides a heat seal between various portions of tube 140. Any or all of sealing bars 134*a*, 134*b*, 135*a*, 135*b* can have a knife or blade, or other mechanism for cutting through tube 140 to form side panels 12, 14 of an individual package. For example, sealing bar 135*b* of FIG. 12 can have a sharp edge, which cuts through tube 140 as bottom seal 36 is made. This cut separates the film to provide side panels 12, 14 of the individual packages. After providing the appropriate seals and cutting, the resulting packages are shown in FIG. 13 as package 10A and package 10B.

Generally, the packages are filled in the process as they are made. Items to fill the package are dropped through column 129 and deposited into the packages, which are then sealed. Referring to FIGS. 12 and 13, package 10A would be filled with items, and then seal bars 134*b*, 135*b* would form bottom seal 36 (FIG. 13). Often simultaneously, seal bars 134*a*, 135*a* would attach side panels 12, 14 securely to zipper closure 20. Package 10B would subsequently be filled, and then indexed to form its bottom seal analogous to bottom seal 36 of package 10A.

The above specification is believed to provide a complete description of the manufacture and use of particular embodiments of the invention. Many embodiments of the invention can be made.

We claim:

1. A method of manufacturing a reclosable package comprising a zipper closure, the reclosable package having first and second sides defining a package width and tie zipper closure extending the width of the package, the method comprising:

(a) providing a film web having first and second edges and a distance therebetween;

(b) forming first aid second notches in the film web at the first and second edges each of tie first and second notches having a longitudinal length and a width, wherein the sum of the first width and the second width is approximately one-half of the distance between first and second edges;

(c) forming a pocket in the film web between the first and second notches;

(d) providing a zipper closure having:

(i) a first interlocking mating profile and a second interlocking mating profile, each profile having a sealing flange and an opposite distal end;

(e) inserting the zipper closure into the pocket and attaching the sealing flanges to the pocket;

(f) joining the first side edge to the second side edge of the film web approximately perpendicular to the zipper closure to form a casement;

(g) forming a bottom edge to provide an interior defined by die casement and the bottom edge; and (h) forming a top edge.

2. The method according to claim 1, wherein the step of providing a zipper closure comprises:

(a) providing a zipper closure comprising:

(i) the first mating profile having a distal end connected to the distal end of the second mating profile.

3. The method according to claim 2, wherein the step of providing a zipper closure comprises:

(a) providing a zipper closure comprising:

(i) the first mating profile having a distal end integral with the distal end of the second mating profile.

4. The method according to claim 2, wherein the step of providing a zipper closure comprises:

(a) providing a zipper closure comprising:

(i) an area of weakness positioned within the zipper closure between the first mating profile distal end and the second mating profile distal end.

5. The method according to claim 4, wherein the step of providing a zipper closure comprises:

(a) providing a zipper closure comprising:

(i) a first area of weakness within the first mating profile; and (ii) a second area of weakness within the second mating profile.

6. The method according to claim 1, wherein the step of forming a pocket in the film web between the first and second notches and the step of inserting the zipper closure into the pocket and attaching the sealing flanges to the pocket is done simultaneously.

7. The method according to claim 1, wherein the pocket has a pocket length, and wherein the step of providing a zipper closure comprises:

(a) providing a zipper closure having a length approximately equal to the pocket length.

8. The method according to claim 1, wherein the step of joining the first side edge to the second side edge of the film web approximately perpendicular to the zipper closure to form a casement comprises:

(a) positioning the film web around a column; and (a) joining the first side edge and the second side edge of the film web.

9. The method according to claim 1, wherein the step of forming first and second notches in the film web at the first and second edges comprises:

(a) forming first and second notches wherein each notch width is approximately one-fourth of the package width.

10. The method according to claim 1, wherein the step of forming first and second notches in the film web at the first and second edges comprises:

(a) forming first and second notches wherein each notch-length is approximately equal to a length of a tamper evident-structure extending between first scaling flange and second sealing flange of the zipper closure.

11. The method according to claim 1, wherein the step of forming first and second notches in the film web at the first and second edges comprises:

(a) forming first and second notches wherein each notch width is approximately one-fourth of the distance between first and second edges.

12. A package made according to the method of claim 1.

* * * * *

UNITED STATES PATENT AND TRADEMARK OFFICE

CERTIFICATE OF CORRECTION

PATENT NO. : 6,530,870 B2
DATED : March 11, 2003
INVENTOR(S) : James E. Buchman et al.

It is certified that error appears in the above-identified patent and that said Letters Patent is hereby corrected as shown below:

Column 8,
Lines 45 and 52, “tie” should read -- the --.
Line 51, “aid” should read -- and --.

Column 9,
Line 2, “die” should read -- the --.

Signed and Sealed this

Second Day of September, 2003

JAMES E. ROGAN
*Director of the United States Patent and Trademark Office*